US008564483B2

(12) United States Patent
Kuo

(10) Patent No.: US 8,564,483 B2
(45) Date of Patent: Oct. 22, 2013

(54) ANTENNA ASSEMBLY WITH IMPROVED SUPPORTING DEVICE

(75) Inventor: Peter Kuo, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 405 days.

(21) Appl. No.: 12/965,939

(22) Filed: Dec. 13, 2010

(65) Prior Publication Data

US 2011/0140986 A1 Jun. 16, 2011

(30) Foreign Application Priority Data

Dec. 11, 2009 (TW) ..... 98223197

(51) Int. Cl.
*H01Q 1/38* (2006.01)

(52) U.S. Cl.
USPC ..... 343/700 MS; 343/848

(58) Field of Classification Search
USPC ..... 343/700 MS, 702, 846, 848
See application file for complete search history.

(56) References Cited

U.S. PATENT DOCUMENTS 7,889,147 B2 * 2/2011 Tam et al. ..... 343/777

* cited by examiner

*Primary Examiner* — Tan Ho
(74) *Attorney, Agent, or Firm* — Wei Te Chung; Ming Chieh Chang

(57) ABSTRACT

An antenna assembly includes an antenna and a supporting portion. The antenna includes a radiating element, a grounding element and a connecting element connecting the radiating element and the grounding element. The supporting portion is located between the radiating element and the grounding element, and includes a base portion and a complementary portion assembled on the base portion. The complementary portion has an outer surface being flush with one of the surfaces of the base portion.

20 Claims, 4 Drawing Sheets

ANTENNA ASSEMBLY WITH IMPROVED SUPPORTING DEVICE

BACKGROUND OF THE INVENTION

1. Field of the Invention

The present invention relates generally to an antenna assembly, and more particularly to an antenna assembly used in electric device and having improved supporting device.

2. Description of the Prior Art

Sometimes, antennas need a supporting device to prevent the structure of the antennas from being changed. The supporting device is always made by insulation material. The different dielectric coefficients of the antenna and the supporting device will influence the performance of the antenna, thus, the supporting device always needs to keep stated dielectric coefficient. However, when the supporting device has a bending surface or enough thickness, the deformation could occurred on the insulation supporting device.

Hence, in this art, an improved antenna assembly to overcome the above-mentioned disadvantages of the prior art should be provided.

BRIEF SUMMARY OF THE INVENTION

A primary object, therefore, of the present invention is to provide an antenna assembly with an improved supporting device.

In order to implement the above object, the antenna assembly comprises an antenna and a supporting portion. The antenna comprises a radiating element, a grounding element and a connecting element connecting the radiating element and the grounding element. The supporting portion is located between the radiating element and the grounding element, and comprises a base portion and a complementary portion assembled on the base portion. The complementary portion has an outer surface being flush with one of the surfaces of the base portion.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
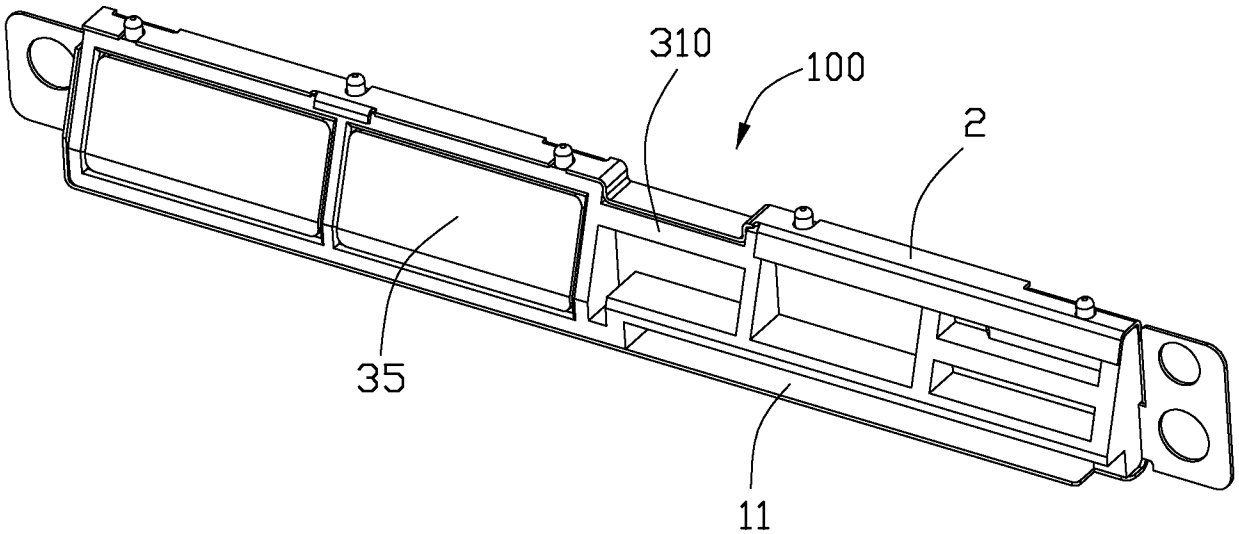
FIG. 1 is a perspective view of an antenna assembly in according with the present invention.
Figure 2:
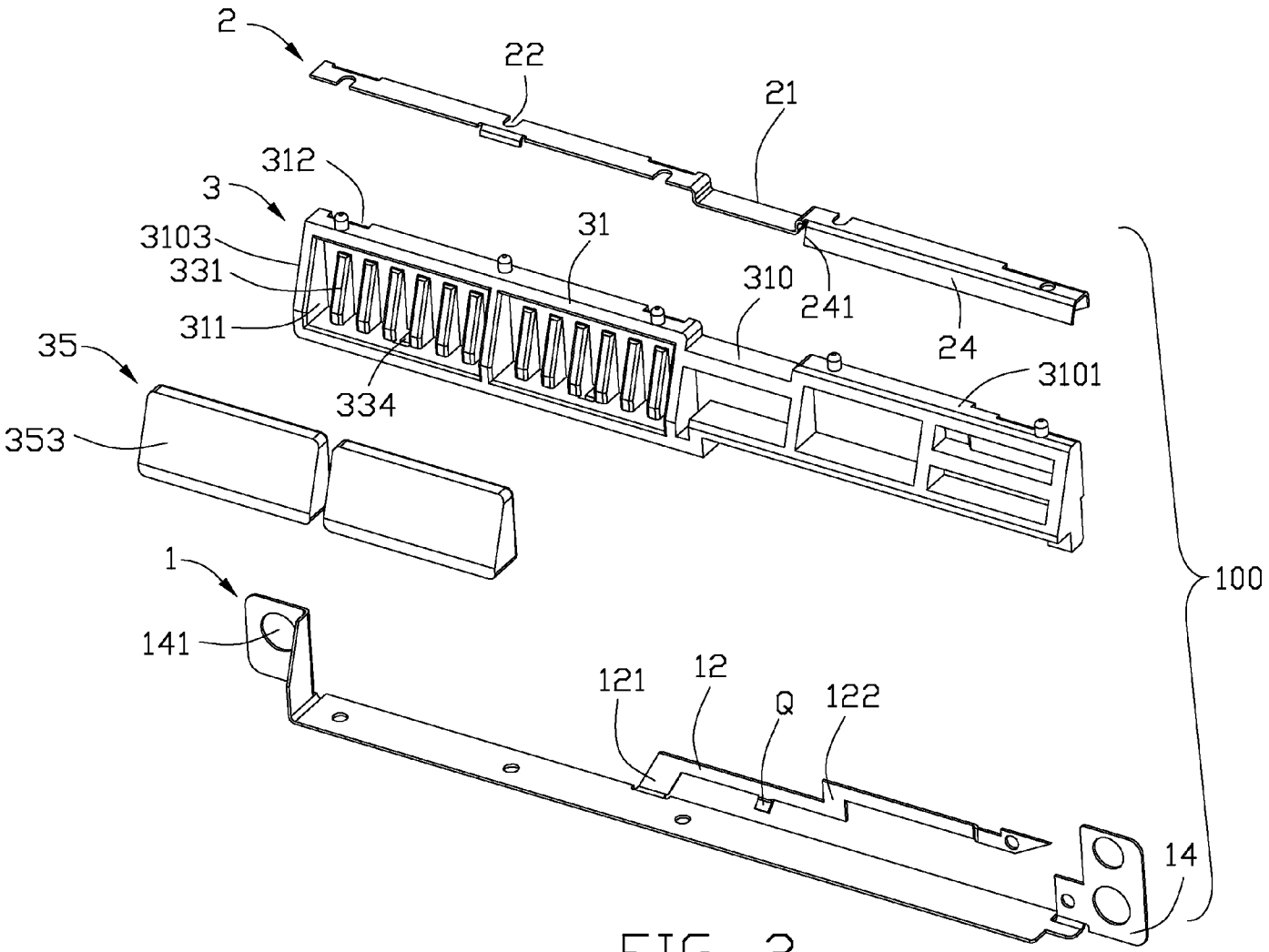
FIG. 2 is an exploded, perspective view of the antenna assembly assembly in according with the present invention.
Figure 3:
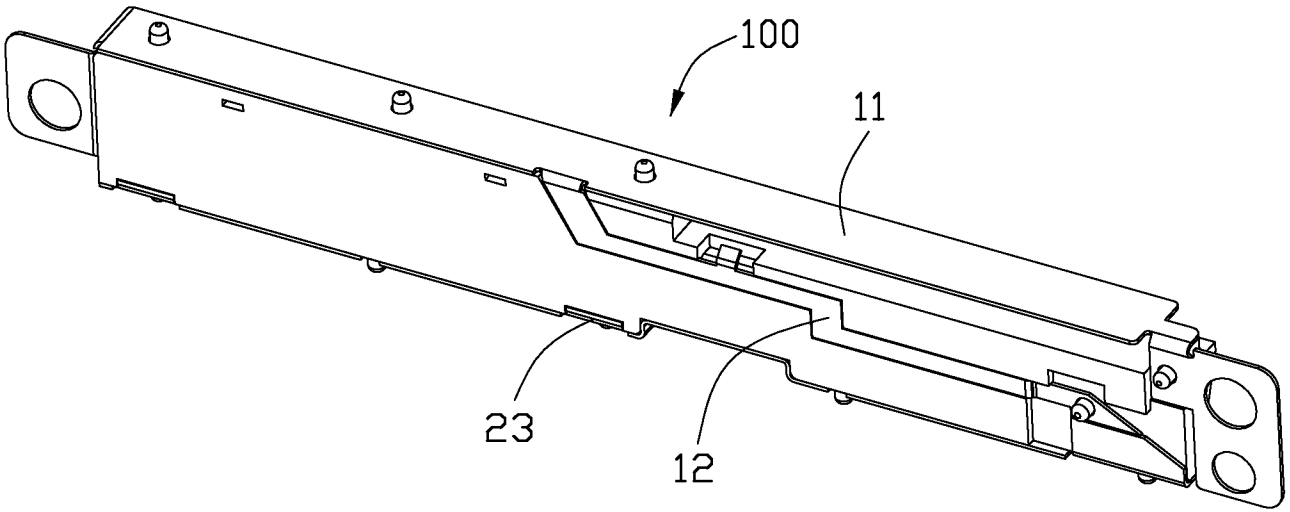
FIG. 3 is a view similar to FIG. 1, but taken from a different aspect.
Figure 4:
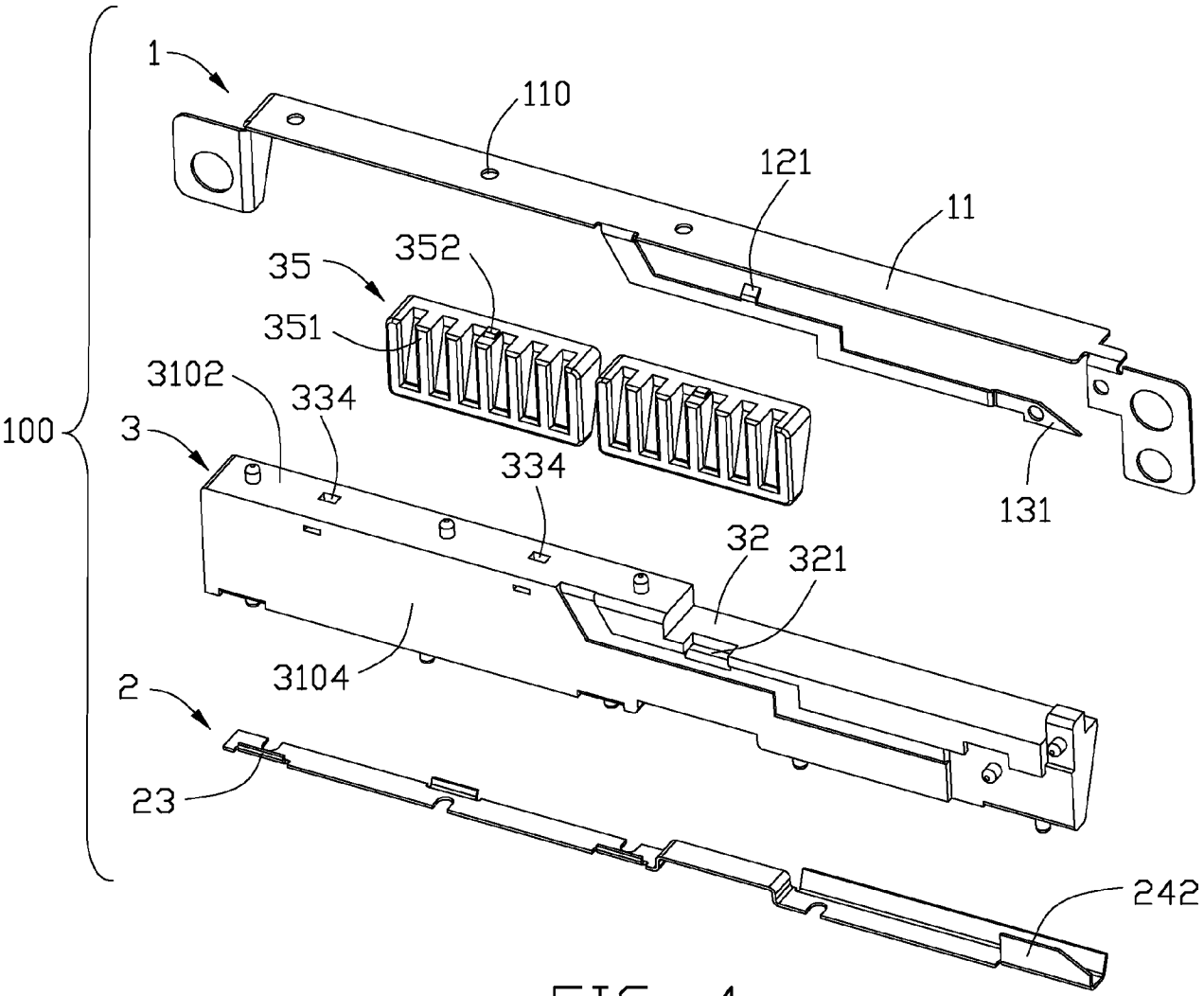
FIG. 4 is a view similar to FIG. 2, but taken from a different aspect.

Reference to FIGS. 1 to 4, an antenna assembly 100 in according with a preferred embodiment of the present invention is shown. The antenna assembly comprises an antenna and a supporting portion 3. The antenna is cut to a first part 1 and a second part 2.

The first part 1 of the antenna is the radiating element of the antenna, and the second part 2 comprises a grounding element 11 parallel to the radiating element 2 and a connecting element 12 for connecting the radiating element 2 and the grounding element 11. The radiating element 2 is substantially composed of a first radiating portion 24, a first L-shaped portion 21 extending from the first radiating portion 24 and a second L-shaped portion 22 extending from the first L-shaped portion 21. The first radiating portion 24 defines a U-like configuration in a side view, and comprises a longer first side wall 241 and a shorter second side wall 242. The connecting element 12 comprises a inclined first side arm 121 and a Z-shaped second side arm 122 extending from the first side arm 121. The second side arm 122 has an end attaching to the second side wall 242 of the radiating element 2 for achieving the electrical connecting between the radiating element 2 and the grounding element 11. A feeding portion Q extends from the connecting element 12 to be connected a feeding line (not shown). The grounding element 11 further comprises a pair of fastening portions 14 extending from two sides thereof, and each fastening portion 14 has a fastening hole 141.

The supporting portion 3 is located between the radiating element 2 and the grounding element 11. The supporting portion 3 comprises a base portion 31 and two complementary portions 35 assembled on the base portion 31. The base portion 31 comprises two receiving space 311 for the complementary portion 35 being received therein, a cutout 310 for receiving the first L-shaped portion 21 of the antenna. Two fastening holes 334 are respectively located in the two receiving spaces 311, and each complementary portion 35 has a fastening protrusion 352 corresponding to the fastening hole 334 and can be inserted into the fastening hole 334. Each receiving space 311 comprises a plurality of clapboards 331 arranged therein to form a plurality of receiving slots, and each complementary portion 35 has a plurality of clapboards 351 can be inserted into the receiving slots. The complementary portion 35 is substantially of trapezium in a side view.

The base portion 31 has an upper surface 3101, a lower surface 3102, a bent side surface 3103 connecting to the upper surface 3101 and the lower surface 3102, a vertical side surface 3104 opposite to the bent side surface 3103. The radiating element 2 and the grounding element 11 are respectively arranged on the upper surface 3101 and the lower surface 3102 of the base portion 31. The connecting element 12 of the antenna attaches to the vertical side surface 3104. Each complementary portion 35 is received in the receiving space and has an outer surface 353 being flush with one of the surfaces of the base portion. In this embodiment, the outer surface 353 of the complementary portion 35 is bent and the outer surface 353 of the complementary portion 35 is flush with the bent side surface 3103 of the base portion 31. The base portion 31 is designed to suit the inner spacer of an electrical device and the structure the antenna. Thus, the base portion 31 further comprise a gap 321 for receiving the feeding portion Q of the antenna and a slots 340 for receiving the connecting element 12 of the antenna. In other embodiments, the detail structure of the base portion 31 can be changed in according to different needs. Through the supporting portion 3 being divided into base portion 31 and the complementary portion 35, the supporting portion 3 is prevented from warping and kept stated dielectric coefficient at the same time.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna assembly, comprising:

an antenna comprising a radiating element, a grounding element and a connecting element connecting the radiating element and the grounding element;

a supporting portion located between the radiating element and the grounding element, and comprising a base portion and a complementary portion assembled on the base portion; wherein the complementary portion has an outer surface being flush with one of the surfaces of the base portion.

2. The antenna assembly as claimed in claim 1, wherein the outer surface of the complementary portion is bent and the base portion has a bent surface.

3. The antenna assembly as claimed in claim 1, wherein the base portion comprises a receiving space and the complementary portion is received in the receiving space.

4. The antenna assembly as claimed in claim 3, wherein the base portion comprises a fastening hole located in the receiving space and the complementary portion has a fastening protrusion corresponding to the fastening hole and can be inserted into the fastening.

5. The antenna assembly as claimed in claim 4, wherein the base portion comprises a plurality of clapboards arranged in the receiving space thereof to form a plurality of receiving slots and the complementary portion has a plurality of clapboards can be inserted into the receiving slots.

6. The antenna assembly as claimed in claim 5, wherein the radiating element is parallel to the grounding element.

7. The antenna assembly as claimed in claim 6, wherein the supporting portion has an upper surface and a lower surface, the radiating element and the grounding element are respectively fastened on the upper surface and lower surface of the supporting portion.

8. The antenna assembly as claimed in claim 7, wherein base portion further has a vertical surface opposite to the bent portion thereof and the connecting element of the antenna attaches to the vertical surface.

9. The antenna assembly as claimed in claim 8, wherein the antenna is cut to two parts, but the connecting element attaches to the radiating element to achieve electrical connecting between the connecting element and the radiating element.

10. The antenna assembly as claimed in claim 9, wherein the antenna further comprises a pair of fastening portion respectively extending from two sides of the grounding element.

11. The antenna assembly as claimed in claim 10, wherein the antenna further comprises a feeding portion extending from the connecting element, and the supporting portion comprises a gap for receiving the feeding portion.

12. An antenna assembly comprising:

an elongated antenna including a radiating element, a grounding element and a connecting element linked therebetween;

an elongated insulative supporting portion on which the antenna is mounted, said supporting portion extending along a lengthwise direction with a region having a less thickness thereof while another region having a greater thickness thereof under condition that a thickness direction is perpendicular to said lengthwise direction; wherein an additional insulative complementary portion, which is discrete from the supporting portion, is attached to the greater region so as to form a complete greater thickness thereof so as to avoid any warpage which may occur if said greater thickness region is formed by an unitary structure.

13. The antenna assembly as claimed in claim 12, wherein said complementary portion and the supporting portion around said greater thickness region, commonly constitute a whole structure of said greater thickness region as if said greater thickness region is made of one.

14. The antenna assembly as claimed in claim 13, wherein a protrusion-cavity structure is formed between the complementary portion and the supporting portion around said greater thickness region for assuring combination of the complementary portion and the supporting portion around said greater thickness region in said viewpoint of dielectric coefficient.

15. The antenna assembly as claimed in claim 12, wherein a thickness of said supporting portion varies in a vertical direction perpendicular to both said lengthwise direction and said thickness direction.

16. An antenna assembly comprising:

an elongated antenna including a radiating element, a grounding element and a connecting element linked therebetween;

an elongated insulative supporting portion on which the antenna is mounted, said supporting portion extending along a lengthwise direction and defining a thickness direction perpendicular to said lengthwise direction under condition that a thickness of said supporting portion varies in a vertical direction perpendicular to both said lengthwise direction and said thickness direction; and an insulative complementary portion attached to the supporting portion for adjusting dielectric coefficient of the supporting portion in the thickness direction.

17. The antenna assembly as claimed in claim 16, wherein the grounding element is located on one plane of the supporting portion while both the connecting element and the radiating element are located on another one plane.

18. The antenna assembly as claimed in claim 17, wherein the plane where the grounding element is located, is parallel to the thickness direction while the plane where the connecting element and the radiating element are located, is perpendicular to said thickness direction.

19. The antenna assembly as claimed in claim 18, wherein the supporting portion defines a wedged configuration in a side view with a dimension varies in said vertical direction.

20. The antenna assembly as claimed in claim 19, wherein a portion of said supporting portion is intentionally removed in said thickness direction for adjust dielectric coefficient thereof.

* * * * *